US005335428A

United States Patent [19]

Wang

[11] Patent Number: 5,335,428

[45] Date of Patent: Aug. 9, 1994

[54] ROLL UP AND DRYING DEVICE TO BE INCORPORATED IN A RUST CLEANING MACHINE

[76] Inventor: Shunn-Gone Wang, No. 1, Alley 30, Lane 220, Chung-Cheng S. Rd., Yung-Kang Hsiang, Tainan Hsien, Taiwan

[21] Appl. No.: 949,393

[22] Filed: Sep. 22, 1992

[51] Int. Cl.[5] ..... F26B 13/00

[52] U.S. Cl. ..... 34/625; 34/482; 242/608.4; 242/613.2

[58] Field of Search ..... 34/12, 104, 105, 106, 34/107, 153, 23, 24, 151; 242/104, 53, 115

[56] References Cited

U.S. PATENT DOCUMENTS

| | | | |
|---|---|---|---|
| 1,983,221 | 12/1934 | Furness | 34/153 |
| 2,070,252 | 2/1937 | Borner | 34/153 |
| 2,319,812 | 5/1943 | Gram | 34/153 |
| 2,501,776 | 3/1950 | Kuljian | 34/153 |
| 2,572,268 | 10/1951 | Kuljian | 34/153 |
| 2,574,833 | 11/1951 | Kuljian | 34/153 |
| 2,606,357 | 8/1952 | Pendleton | 34/153 |
| 2,613,451 | 10/1952 | Kuljian | 34/153 |
| 2,660,808 | 12/1953 | Birmingham | 34/153 |

*Primary Examiner*—Denise Gromada
*Attorney, Agent, or Firm*—Ladas & Parry

[57] ABSTRACT

A roll up and drying device to be incorporated in a rust cleaning machine includes a main shaft on which a pair of spaced, identical circular plates are concentrically and fixedly mounted on the main shaft and a plurality of connecting ribs screw connecting the spaced plates adjacent to the peripheries of the plates. The connecting ribs are in the shape of truncated cones.

2 Claims, 5 Drawing Sheets

ROLL UP AND DRYING DEVICE TO BE INCORPORATED IN A RUST CLEANING MACHINE

BACKGROUND OF THE INVENTION

1. Field of Invention

This invention relates to a rust cleaning machine, more particularly to a roll up and drying device of the rust cleaning machine which can roll up and dry an iron wire which has gone through the rust cleaning operation.

2. Description of the Related Art

FIGS. 1 and 2 show a side and top views, respectively, of a conventional rust cleaning machine (A) comprising a plurality of rolling rollers (A1) through which an iron wire corroded with rust passes, so that the rollers can crush the rust formed on the iron wire, brushing means (A2) which brushes off the crushed rust, a liquid spraying and cleaning room (A3) and lubricating oil smearing room (A4). The cleaned iron wire (B) is blown by a dryer (A6) which is disposed below the cleaning and smearing rooms when the rust-free iron wire is rolled up on a roll up assembly (A5) of the conventional rust cleaning machine (A).

Such type of rust cleaning method does not cause pollution or contamination and therefore is preferable to the users. In the above-mentioned roll up assembly, a roller is employed for rolling up the continuous iron wire. After the roll up operation, the cleaned, rust-free iron wire (B) must be made into a smaller iron wire by means of a drawing method. It happens that during the drawing operation, a free end of the iron wire which is rolled on the roller is pulled by a pulling device. Friction between the cleaned rust-free iron wire and an external surface of the roll up roller (A5) will cause uneven surface on the roll up roller in the long run. The uneven surface hinders the smooth sliding of the rust corroded iron wire which is to be cleaned and later taken up on the roller. The roll up roller must be replaced in order to avoid the drawback. Changing and replacement of the roll up roller therefore becomes necessary, which is troublesome and uneconomical.

SUMMARY OF THE INVENTION

The main object of the present invention is to provide a new roll up and drying device which is to be incorporated in a rust cleaning machine so that the above-mentioned drawback does not occur.

According to the present invention, a roll up and drying device to be incorporated in a rust cleaning machine includes a main shaft on which a pair of spaced, identical circular plates are concentrically and fixedly mounted and a plurality of connecting rods screw-connecting the circular plates so that the connecting ribs can be detached if desired. Each of the connecting rods is of a truncated cone shape and includes a first end with a diameter that gradually decreases from the first end towards a second end of the truncated cone.

BRIEF DESCRIPTION OF THE DRAWINGS

Other features and advantages of the present invention will become more apparent in the following detailed description, including drawings, all of which shows a non-limiting form of the present invention, and in which.

DETAILED DESCRIPTION OF THE PREFERRED EMBODIMENT

Figure 1:
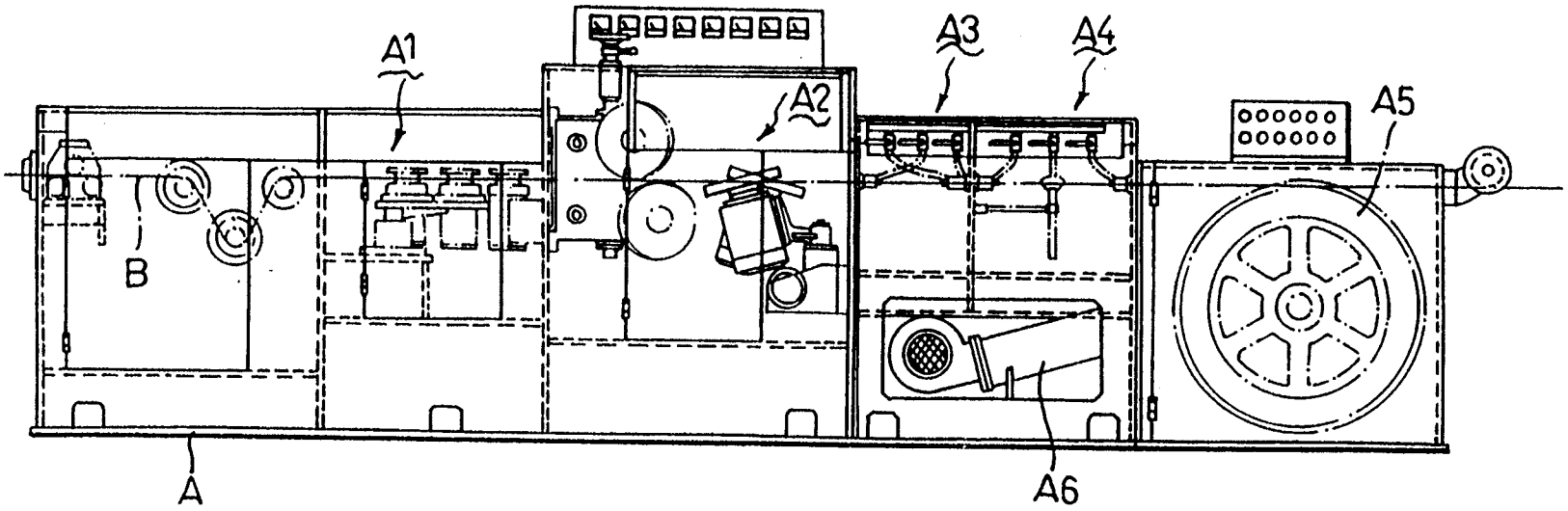
FIG. 1 PRIOR ART
FIG. 1 shows a side view of a conventional rust cleaning machine.
Figure 2:
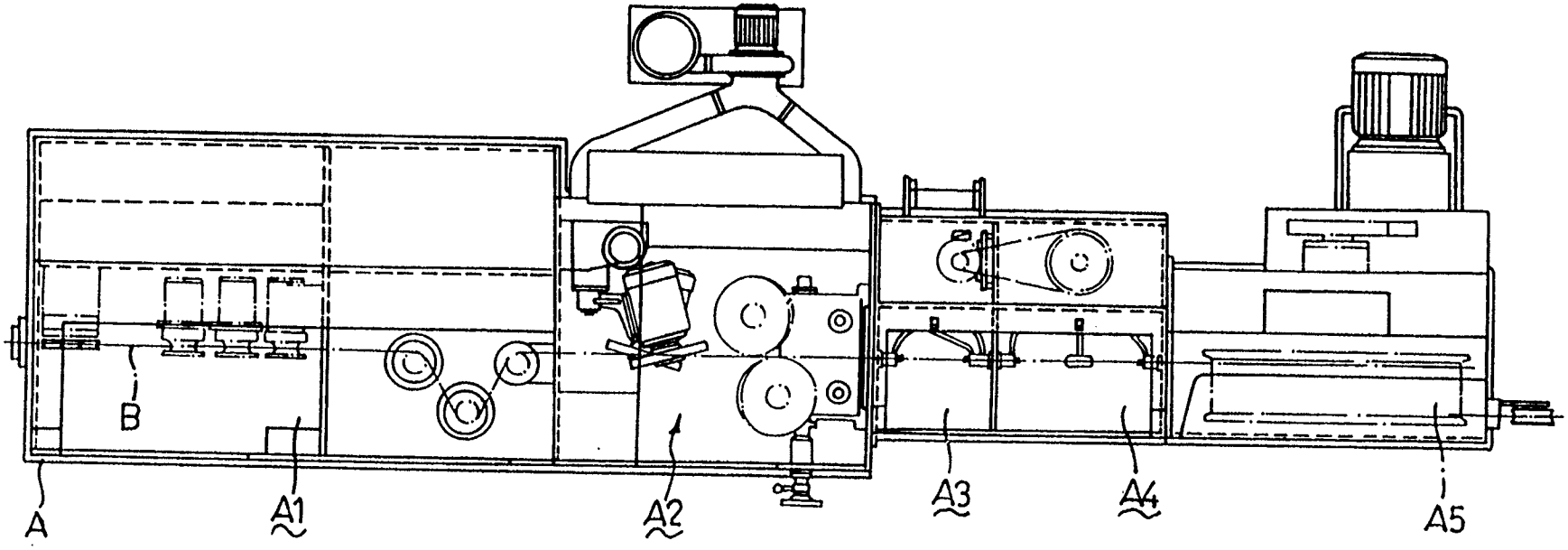
FIG.2 PRIOR ART
FIG. 2 shows the top view of the conventional rust cleaning machine of FIG. 1.
Figure 3:
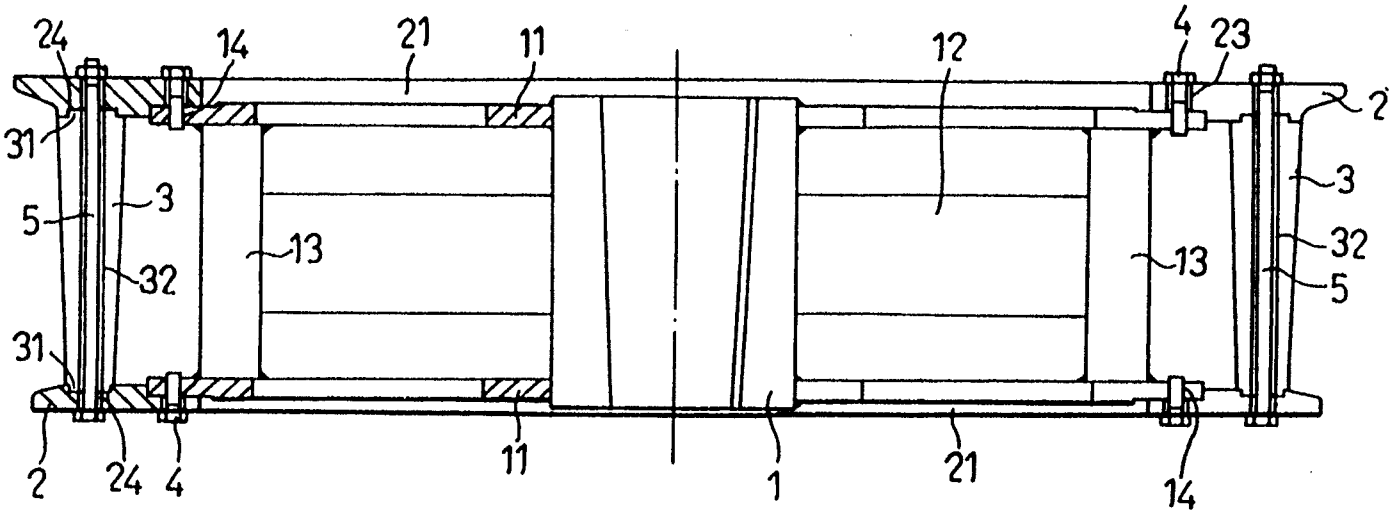
FIG. 3 shows a cross sectional view of a roll up and drying assembly of the present invention which is to be incorporated in the conventional rust cleaning machine shown in FIG. 1.
Figure 4:
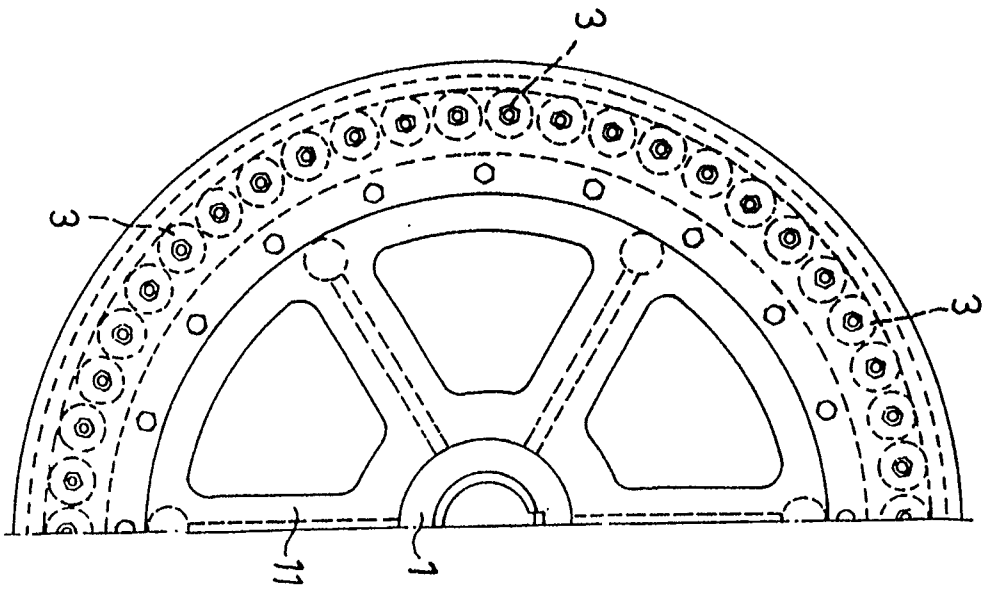
FIG. 4 shows a side view of the roll up and drying assembly of the present invention.

Referring to FIGS. 3 and 4, a roll up assembly according to the present invention and which is to be incorporated in a conventional rust cleaning machine includes a main shaft (1), a pair of spaced, identical outer plates (2) and a plurality of connecting rods (3).

A pair of spaced, identical circular plates (11) is concentrically and fixedly mounted on the main shaft (1). Each of the circular plates (11) has a circle of openings formed around the center thereof in such a manner that each of the openings is spaced angularly from each other. A plurality of reinforcing stands (13) connects the two circular plates (11) rigidly so as to form a rigid frame. The frame is further strengthened by a plurality of radially extending connecting ribs (12) which interconnect the main shaft (1) to the reinforcing stands (13). Each of the circular plates (11) further includes a plurality of through holes (14) formed adjacent to the periphery thereof.

A pair of outer plates (2), each of which has a central opening (21) communicating with the circular opening of the circular plates (11) and an outer diameter larger than that of the circular plate (11) is attached to an external surface of the circular plates (11). Since each of the outer plates (2) has a plurality of through holes (23) circumferentially formed thereon and respectively aligned with the through holes (14) on the circular plates (11), a plurality of locking screws (4) can be inserted into the through holes (14, 23) so as to secure the outer and circular plates (2, 11). The two plates (11, 2) can also be connected by a male-female connection.

The connecting rods (3) are provided between the two outer plates (2) and are fastened detachably by a plurality of locking bolts (5). In order to provide a firm positioning of the connecting rods 3 between the two outer plates (2), the inner surface of the outer plates (2) is provided with a recess (24) which can fittingly receive projections (31) of the connecting rods. (3). The connecting rods (3) in this preferred embodiment are in the shape of a truncated cone and each has a first end with an enlarged portion that gradually decreases in size to the second end. It also has a through bore (32) which permits the locking bolts (5) to pass through. The tapered ends of the truncated cones extend in the same direction. Therefore, the tapered surface of the truncated cones generally provides a pushing force on the iron wire which is being wound on the connecting rods (3), which force concentrates toward the tapered end of the truncated cone and assists in an automatic lining of the iron wire on the truncated cone (5) during the winding operation.

Figure 5:
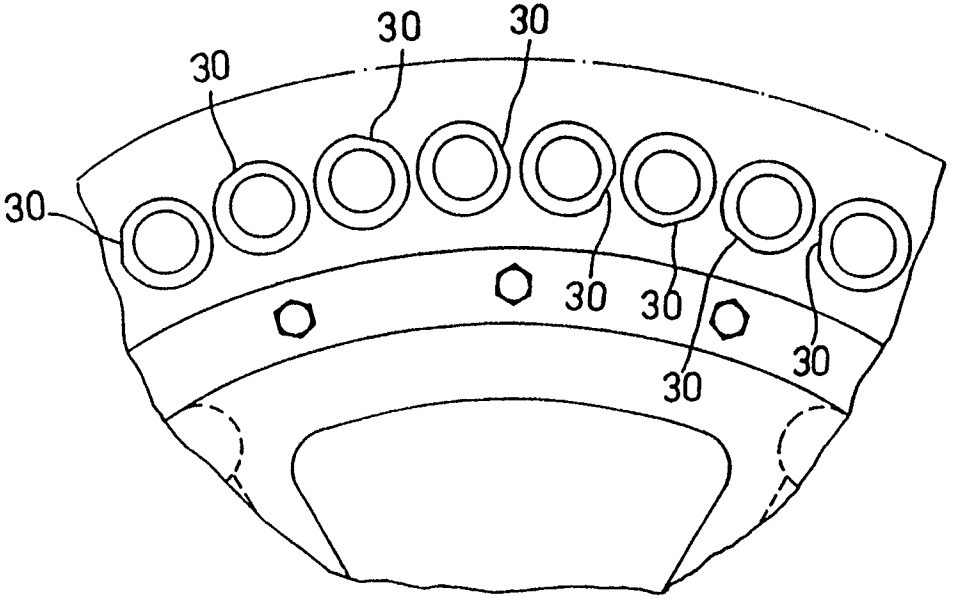
FIG. 5 shows an enlarged view of the roll up and drying assembly of the present invention, illustrating the rubbed external surface of the connecting rod of the roll up assembly.

An important aspect to be noted is that the connecting rods (3) are arranged in such a manner that each is slightly and circumferentially spaced so as to form a roller. During the drawing operation of the iron wire, some sections (30) on the external surface of the connecting rods (3) get worn out, as shown in FIG. 5. If this occurs, the locking bolts (5) are unscrewed and the connecting rods (3) are rotated and re-adjusted so as to provide a smooth surface. The adjustment of the connecting rods (3) can be done a number of times. The adjustments are easy and simple and does not take much time since detachment of the connecting rods (3) is not required. In the conventional roll up and drying device, a roller is employed in place of the connecting rods. It takes some time to detach the roller. In addition thereto, the construction of a roller costs more than the connecting rods and therefore, this device is more economical.

The manner in which the cleaned rust-free iron wire is dried on the roll up device of the present invention, is similar to that of the prior art and therefore a detailed disclosure thereof is not included here.

With the invention thus explained, it is obvious to those skilled in the art that various modifications and variations can be made in the general arrangement and construction without departing from the spirit and scope thereof. It is therefore intended that the scope of the present invention be interpreted treated only in light of the appended claims.

I claim:

1. A roll up and drying device for a rust cleaning machine, said roll up and drying device for drying and rolling up an iron wire which is cleaned of rust by said rust cleaning machine, said roll up and drying device comprising;

a main shaft having a pair of spaced, identical circular plates concentrically and fixedly mounted thereon, a pair of outer plates, each of said outer plates having an inner diameter that is larger than the diameter of said circular plates and each being detachably attached to an external surface of one of said circular plates and concentric thereto and a plurality of truncated cone-shaped connecting rods screw-connecting said pair of outer plates adjacent to the peripheries of said pair of outer plates, each of said connecting rods being spaced from one another at a predetermined angular distance.

2. A roll up and drying device as defined in claim 1, wherein each said truncated cone includes a first end with a diameter which gradually decreases to a second end of said truncated cone.

* * * * *